US008776570B2

(12) United States Patent
Maeda et al.

(10) Patent No.: US 8,776,570 B2
(45) Date of Patent: Jul. 15, 2014

(54) WORKPIECE BENDING METHOD AND APPARATUS

(75) Inventors: Kazuhisa Maeda, Toyota (JP); Yoshiyuki Fukuyama, Toyota (JP); Tatsuya Asai, Kakogawa (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 784 days.

(21) Appl. No.: 13/054,699

(22) PCT Filed: Jul. 17, 2009

(86) PCT No.: PCT/IB2009/006297

§ 371 (c)(1), (2), (4) Date: Jan. 18, 2011

(87) PCT Pub. No.: WO2010/007521

PCT Pub. Date: Jan. 21, 2010

(65) Prior Publication Data

US 2011/0120204 A1 May 26, 2011

(30) Foreign Application Priority Data

Jul. 18, 2008 (JP) ..... 2008-187526

(51) Int. Cl.
*B21D 31/00* (2006.01)
*B21D 5/02* (2006.01)

(52) U.S. Cl.
USPC ..... 72/379.2; 72/380

(58) Field of Classification Search
USPC ..... 72/316, 319, 379.2, 380, 381, 383, 384, 72/386, 387, 388
See application file for complete search history.

(56) References Cited

U.S. PATENT DOCUMENTS

| | | | | |
|---|---|---|---|---|
| 2,162,731 | A * | 6/1939 | Lyon | 29/509 |
| 4,553,420 | A * | 11/1985 | Fierkens et al. | 72/380 |
| 6,988,390 | B2 * | 1/2006 | Jeandeaud et al. | 72/379.2 |
| 2003/0061852 | A1 | 4/2003 | Yamano et al. | |
| 2004/0187542 | A1 | 9/2004 | Golovashchenko et al. | |

FOREIGN PATENT DOCUMENTS

| | | | | |
|---|---|---|---|---|
| EP | 1 602 418 | A2 | 12/2005 | |
| JP | 58-97428 | * | 6/1983 | B21D 19/12 |

(Continued)

OTHER PUBLICATIONS

Office Action issued Aug. 1, 2012 in Korean Patent Application No. 10-2011-7001259 (with English-language translation).
International Search Report issued Jan. 22, 2010 in PCT/IB09/006297 filed Jul. 17, 2009.

(Continued)

*Primary Examiner* — Edward Tolan
(74) *Attorney, Agent, or Firm* — Oblon, Spivak, McClelland, Maier & Neustadt, L.L.P.

(57) ABSTRACT

A workpiece bending method of forming a final formed article that has two surfaces on opposite sides of an inclined area, in which an inclined area is made up of a first bend portion, a second bend portion, and a flat surface portion, includes: cantilevering an end portion of a workpiece by a stationary die and a holding member; and curving an area in the workpiece that corresponds to the flat surface portion by moving a movable die to the stationary die so that the movable die presses a free-end side of the workpiece, and then forming the first bend portion and the second bend portion, and unbending the area in the workpiece that corresponds to the flat surface portion of the inclined area, by causing the movable die to press the workpiece to the stationary die.

2 Claims, 12 Drawing Sheets

(56) References Cited

FOREIGN PATENT DOCUMENTS

| | | | | | |
|---|---|---|---|---|---|
| JP | 60 009521 | | | 1/1985 | |
| JP | 60-210328 | A | * | 10/1985 | ..... B21D 19/08 |
| JP | 61 082929 | | | 4/1986 | |
| JP | 04 147718 | | | 5/1992 | |
| JP | 2003 094115 | | | 4/2003 | |
| JP | 2003-103306 | A | | 4/2003 | |
| JP | 2005 177790 | | | 7/2005 | |
| JP | 2005 254262 | | | 9/2005 | |
| JP | 2009 262168 | | | 11/2009 | |

OTHER PUBLICATIONS

Office Action issued Apr. 27, 2010, in Japanese Patent Application No. 2008-187526, filed Jul. 18, 2008 (with English language translation).

Office Action issued Nov. 2, 2010, in Japanese Patent Application No. 2008-187526, filed Jul. 18, 2008 (with English language tranlsation).

Fumio Yamaguchi, "U-Bending Process, 3.2.2: Bending Process for U-Bent Shape", Learning from basics Practical press working series, Process planning for press working, Japan Metal Stamping Association, ISBN: 4-526-04939-5, May 15, 2002, 8 pages.

* cited by examiner

WORKPIECE BENDING METHOD AND APPARATUS

BACKGROUND OF THE INVENTION

1. Field of the Invention

The invention relates to workpiece bending method and apparatus for forming a final formed article that has two surface that are continuous across a boundary that is a bend portion, by bending a flat workpiece through the use of a stationary die and a movable die that are disposed facing each other.

2. Description of the Related Art

In recent years, the achievement of both collision safety improvement and a vehicle body weight reduction that is made for the purpose of cutting down the amount of $CO_2$ emission through fuel economy improvement is a most crucial issue regarding motor vehicles. As a measure for meeting both of these conflicting requirements, the application of a high-strength steel sheet to a motor vehicle body is increasingly adopted. A press-formed steel sheet as a motor vehicle component member basically has a so-called box-like or hat-like sectional shape in which a plurality of inclined areas are formed. In order to secure dimensional accuracy of the press forming, it is important to control the amount of spring-back of the inclined areas. However, since a high-strength steel sheet having high material strength (e.g., a material strength of about 590 MPa) has great spring-back following the press forming process, it is difficult to secure good dimensional accuracy without some measure.

Therefore, in a common practice according to the related art, the amount of spring-back following the press forming is taken into account in the designing of the forming die so that the press-forming object workpiece is over-bent. In this manner, a dimensional accuracy of the bend angle can be secured.

However, the material strength of the high-strength steel sheets used as motor vehicle component members has become higher year by year. In recent years, it is highly necessary to apply high-strength steel sheets having material strength of 980 MPa or higher, to motor vehicle component members.

Thus, if the material strength of the high-strength steel sheet is heightened, the post-press-forming spring-back also increases. Therefore, in the case where a certain amount of spring-back is taken into account in the construction of the forming die as in the related art, the amount of spring-back taken into account becomes large so that the number of man-hours needed to repair or renew the forming dies increases and the repair operation becomes complicated. Besides, in some cases, depending on the shape to be press-formed, the over bending angle is less than 90°, which may cause a problem In the press forming. Furthermore, in the case where the material strength of the high-strength steel sheet is high, the characteristics, including the material strength and the like, vary to great extents from a workpiece to another; therefore, even if the spring-back is taken into account in the construction of the forming dies, the bend angles after the press forming are not consistent, and it is difficult to secure bend angle accuracy.

Besides, a press-forming method that reduces the amount of spring-back in the press forming of a high-strength steel sheet is shown in Japanese Patent Application Publication No. 2005-254262 (JP-A-2005-254262).

In the metal sheet processing method shown in Japanese Patent Application Publication No. 2005-254262 (JP-A-2005-254262), a vertical wall of a formed article that has a hat-like sectional shape is formed to about a half of the height thereof in a first forming process, and the rest of the height of the vertical wall is added and connected to the about half of the height of the wall in a second forming process. In the first and second forming processes, the bending and unbending at a die shoulder of a die is performed. In a disclosed method, the direction in which the steel sheet is pressed to the die shoulder in the second forming process is made opposite to the direction of the pressing to a die shoulder performed in the first forming process. Therefore, the wall formed in the second forming process serves as a spring-go element, and thus reduces the spring-back of the formed article.

However, the processing method described in Japanese Patent Application Publication No. 2005-254262 (JP-A-2005-254262) is intended to reduce the amount of spring-back in the vertical wall portion, and not to reduce the amount of spring-back of a bend portion of the workpiece. Therefore, the application merely of the forming method described in Japanese Patent Application Publication No. 2005-254262 (JP-A-2005-254262) will not secure dimensional accuracy of the bend angle.

SUMMARY OF THE INVENTION

Therefore, the invention provides workpiece bending method and apparatus securing dimensional accuracy of the bend angle of a bend portion of a workpiece by reducing the amount of spring-back of the bend portion of the workpiece.

A first aspect of the invention is a workpiece bending method of forming a final formed article that has two surfaces on opposite sides of an inclined area by bending a flat workpiece using a stationary die and a movable die, wherein a shape of the inclined area in the final formed article is made up of a first bend portion, a second bend portion, and a flat surface portion sandwiched between the first bend portion and the second bend portion. The method includes: a workpiece holding step of cantilevering the workpiece by clamping an end portion of the workpiece by the stationary die and a holding member that is disposed facing the stationary die; and a forming step of curving an area in the workpiece that corresponds to the flat surface portion of the inclined area by moving the movable die to the stationary die so that the movable die presses a free-side end of the cantilevered workpiece toward the stationary die, and of then forming the first bend portion and the second bend portion by causing the movable die to press the workpiece to the stationary die whose shapes correspond to a shape of the inclined area in the final formed article, and unbending the area in the workpiece that corresponds to the flat surface portion of the inclined area. Therefore, the spring-back that occurs in the inclined area can be offset by the spring-go that occurs in a portion that is flexed by the curvature of the area that corresponds to the flat surface portion. Thus, it becomes possible to form a final formed article with high dimensional accuracy of the bend angle in the inclined area.

A second aspect of the invention is a workpiece bending method of forming a final formed article that has two surfaces on opposite sides of an inclined area by bending a flat workpiece using a stationary die and a movable die, wherein a shape of the inclined area in the final formed article is made up of a first bend portion, a second bend portion, and a flat surface portion sandwiched between the first bend portion and the second bend portion. The method includes: a step of forming a preliminary bend portion having the same bend direction as the first bend portion and the second bend portion, in an area in the workpiece that corresponds to the flat surface portion of the inclined area; a workpiece holding step of cantilevering the workpiece by clamping an end portion of the workpiece by the stationary die and a holding member that is disposed facing the stationary die; and a forming step of curving an area in the workpiece that corresponds to the flat surface portion of the inclined area by moving the movable die to a stationary die so that the movable die presses a free-side end of the cantilevered workpiece toward the stationary die, and of then forming the first bend portion and the second bend portion by causing the movable die to press the workpiece to the stationary die whose shapes correspond to a shape of the inclined area in the final formed article, and unbending the area in the workpiece that corresponds to the flat surface portion of the inclined area and that includes the preliminary bend portion. Therefore, the spring-back that occurs in the inclined area can be sufficiently offset by the spring-go that occurs in the preliminary bend portion and in a portion that is flexed by the curvature of the area that corresponds to the flat surface portion. Thus, it becomes possible to form a final formed article with high dimensional accuracy of the bend angle in the inclined area.

In the first and second aspects, in the forming step, before the workpiece is pressed by the movable die to the stationary die, a stabilized bend portion may be formed in the workpiece by bringing the workpiece into contact with an area in the stationary die that is provided for forming the second bend portion, and after the stabilized bend portion is formed, the stabilized bend portion may be unbent by causing the movable die to press the workpiece to the stationary die. Therefore, by utilizing the spring-go that occurs in the stabilized bend portion as well, the spring-back that occurs in the bend portion of the final formed article can be more certainly reduced. Thus, it becomes possible to improve the dimensional accuracy of the bend angle of the bend portion of the final formed article.

A third aspect of the invention is a workpiece bending apparatus for forming a final formed article that has two surfaces on opposite sides of an inclined area by bending a workpiece. The apparatus includes a stationary die, and a movable die and a holding member that are disposed facing the stationary die. The movable die and the stationary die have shapes that correspond to a shape of the inclined area in the final formed article, and the workpiece is cantilevered by clamping an end portion of the workpiece by the stationary die and the holding member. By moving the movable die to a stationary die so that the movable die presses a free-side end of the workpiece, the bending apparatus curves an area in the workpiece that corresponds to the flat surface portion of the inclined area. After that, by causing the movable die to press the workpiece to the stationary die, the apparatus forms the inclined area made up of a first bend portion, a second bend portion, and a flat surface portion sandwiched between the first bend portion and the second bend portion, and unbends the area in the workpiece that corresponds to the flat surface portion of the inclined area. Therefore, the spring-back that occurs in the inclined area can be offset by the spring-go that occurs in a portion that is flexed by the curvature of the area that corresponds to the flat surface portion. Thus, it becomes possible to form a final formed article with high dimensional accuracy of the bend angle in the inclined area.

A fourth aspect of the invention is a workpiece bending apparatus for forming a final formed article that has two surfaces on opposite sides of an inclined area by bending a workpiece. The apparatus includes a stationary die, and a movable die and a holding member that are disposed facing the stationary die. The movable die and the stationary die have shapes that correspond to a shape of the inclined area in the final formed article, and the workpiece in which a preliminary bend portion having the same bend direction as a first bend portion and a second bend portion is formed beforehand in the area in the workpiece that corresponds to the flat surface portion of the inclined area is cantilevered by clamping an end portion of the workpiece by the stationary die and the holding member. By moving the movable die to a stationary die so that the movable die presses a free-side end of the workpiece, the bending apparatus curves an area in the workpiece that corresponds to the flat surface portion of the inclined area. After that, by causing the movable die to press the workpiece to the stationary die, the apparatus forms the inclined area made up of a first bend portion, a second bend portion, and a flat surface portion sandwiched between the first bend portion and the second bend portion, and unbends the area in the workpiece that corresponds to the flat surface portion of the inclined area and that includes the preliminary bend portion. Therefore, the spring-back that occurs in the inclined area can be sufficiently offset by the spring-go that occurs in the preliminary bend portion and in a portion that is flexed by the curvature of the area that corresponds to the flat surface portion. Thus, it becomes possible to form a final formed article with high dimensional accuracy of the bend angle in the inclined area.

In the third and fourth aspects, the workpiece bending apparatus, before pressing the workpiece by the movable die to the stationary die, may form a stabilized bend portion in the workpiece by moving the movable die to the stationary die so as to bring the workpiece into contact with an area in the stationary die that is provided for forming the second bend portion. After forming the stabilized bend portion, the workpiece bending apparatus may unbend the stabilized bend portion by moving the movable die further to the stationary die so that the movable die presses the workpiece to the stationary die. Therefore, by utilizing the spring-go that occurs in the stabilized bend portion as well, the spring-back that occurs in the bend portion of the final formed article can be more certainly reduced. Thus, it becomes possible to improve the dimensional accuracy of the bend angle of the bend portion of the final formed article.

According to the foregoing aspects of the invention, the spring-back that occurs in the inclined area can be offset by the spring-go that occurs in a portion that is flexed by the curvature of the area that corresponds to the flat surface portion. Thus, it becomes possible to form a final formed article with high dimensional accuracy of the bend angle in the inclined area.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Next, modes for carrying out the invention will be described with reference to the accompanying drawings.

Figure 1:
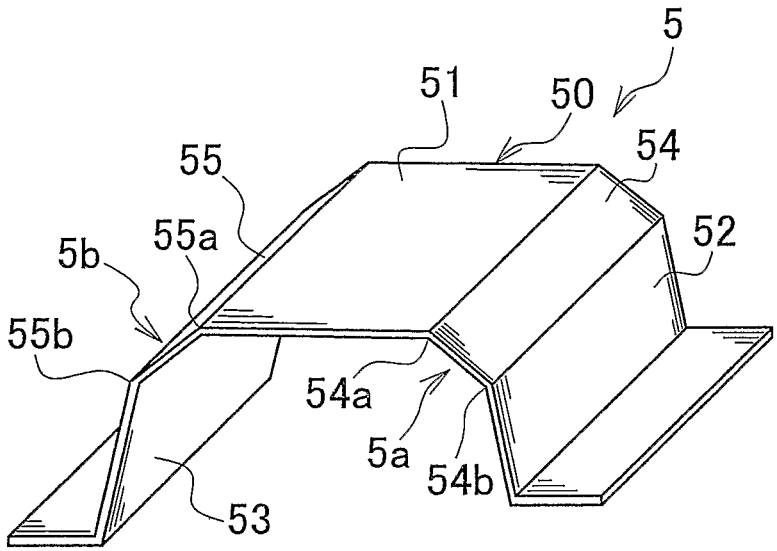
FIG. 1 is a perspective view showing a final formed article that is obtained by bending a work.
Figure 2:
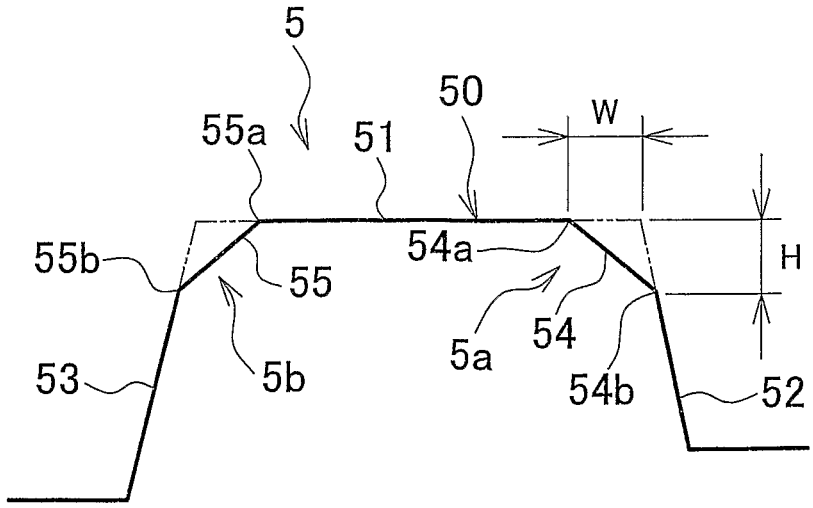
FIG. 2 is a sectional view of the final formed article.

FIGS. 1 and 2 show a final formed article 5 that is obtained by bending (press-forming) a flat workpiece 50 that is formed of a high-strength steel sheet, by workpiece bending method and apparatus according an embodiment of the invention. Incidentally, the material strength of a high-strength steel sheet of the workpiece 50 which is applied to the workpiece bending method and apparatus of this embodiment is not particularly limited. For example, the apparatus and method can be effectively applied to a high-strength steel sheet having a material strength of 980 MPa or greater.

The final formed article 5 has a so-called hat-like sectional shape that has a plurality of bend portions. Concretely, the final formed article 5 has a first inclined area 5*a* and a second inclined area 5*b*. The first inclined area 5*a* is sandwiched between two surfaces, that is, a top plate 51 and a first side plate 52. The second inclined area 5*b* is sandwiched between two surfaces, that is, the top plate 51 and a second side plate 53. In other words, the final formed article 5 is formed so as to have a hat-like sectional shape in which the first side plate 52 and the second side plate 53 are disposed at the two opposite sides of the top plate 51, with the intervening first inclined area 5*a* and the intervening second inclined area 5*b*, respectively, and are bent in the same direction.

The first inclined area 5*a* is constructed of a first bend portion 54*a* and a second bend portion 54*b*, and a flat surface portion 54 sandwiched between the first bend portion 54*a* and the second bend portion 54*b*. That is, the first inclined area 5*a* has a shape that is made up of the first bend portion 54*a* and the second bend portion 54*b*, and the flat surface portion 54 sandwiched between the first bend portion 54*a* and the second bend portion 54*b*. The first bend portion 54*a* is a bent portion disposed between the top plate 51 and the flat surface portion 54, and the second bend portion 54*b* is a bent portion disposed between the first side plate 52 and the flat surface portion 54.

Besides, the second inclined area 5*b* is constructed of a first bend portion 55*a* and a second bend portion 55*b*, and a flat surface portion 55 sandwiched between the first bend portion 55*a* and the second bend portion 55*b*. That is, the second inclined area 5*b* has a shape that is made up of the first bend portion 55*a* and the second bend portion 55*b*, and the flat surface portion 55 sandwiched between the first bend portion 55*a* and the second bend portion 55*b*. The first bend portion 55*a* is a bent portion disposed between the top plate 51 and the flat surface portion 55, and the second bend portion 55*b* is a bent portion disposed between the second side plate 53 and the flat surface portion 55.

That is, the first inclined area 5*a* has a chamfer shape that is formed if an angle shape formed by extending the top plate 51 and the first side plate 52 until they intersect with each other (a shape shown by a two-dot dashed line in FIG. 2) is cut away obliquely to a predetermined width W and a predetermined height H. Thus, the flat surface portion 54 is inclined with respect to both the top plate 51 and the first side plate 52. Likewise, the second inclined area 5*b* has a chamfer shape that is formed if an angle shape formed by extending the top plate 51 and the second side plate 53 until they intersect with each other (a shape shown by a two-dot dashed line in FIG. 2) is cut away obliquely to a predetermined width W and a predetermined height H. Thus, the flat surface portion 55 is inclined with respect to both the top plate 51 and the second side plate 53.

Thus, the final formed article 5 is formed so as to have a shape that has the first inclined area 5*a* and the second inclined area 5*b*, by bending the workpiece 50 along the first bend portion 54*a*, the second bend portion 54*b*, the first bend portion 55*a*, and the second bend portion 55*b* so as to form the top plate 51, the first side plate 52, the second side plate 53, the flat surface portion 54, and the flat surface portion 55.

Next, a bending method for the first inclined area 5*a* and the second inclined area 5*b* of the final formed article 5 that is formed as described above will be described. Incidentally, since the bending method for the first inclined area 5*a*, and the bending method for the second inclined area 5*b* are substantially the same, the bending method for the first inclined area 5*a* will be described below, and the description of the bending method for the second inclined area 5*b* will be omitted.

That is, the first inclined area 5*a*, the first bend portion 54*a*, the second bend portion 54*b*, the first side plate 52 and the flat surface portion 54 of the final formed article 5 and the workpiece 50 in the following description of the bending method for the first inclined area 5*a* correspond to the second inclined area 5*b*, the first bend portion 55*a*, the second bend portion 55*b*, the second side plate 53, and the flat surface portion 55, respectively, of the final formed article 5 and the workpiece 50 in the bending method for the second inclined area 5*b*.

Figure 3:
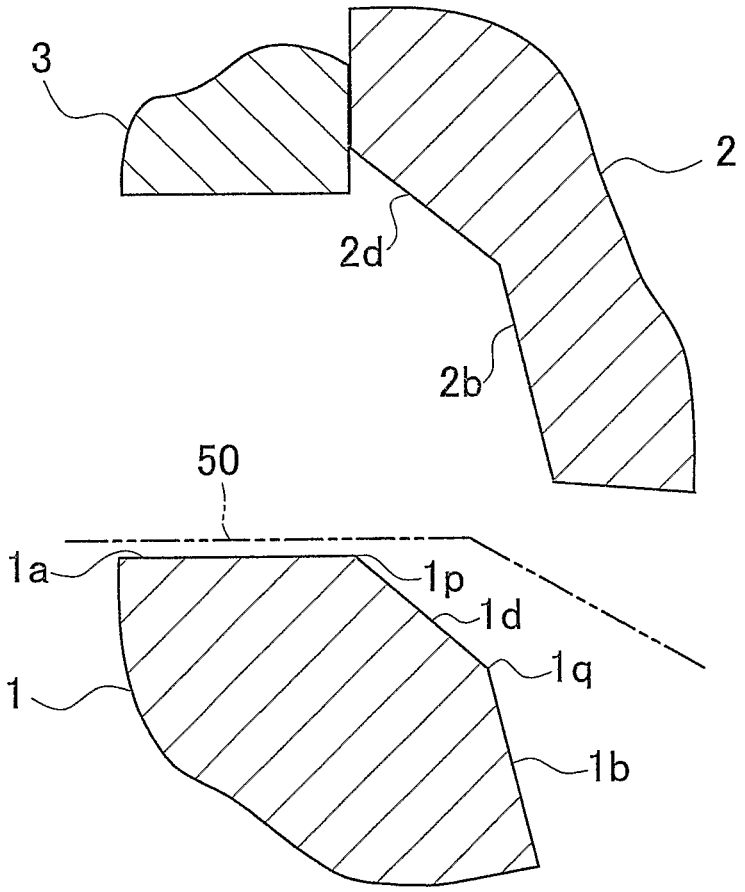
FIG. 3 is side sectional view of a bending apparatus for forming a final formed article.

As shown in FIG. 3, the bending apparatus for forming the final formed article 5 by bending the workpiece 50 includes a punch 1 that is a stationary die as well as a die block 2 and a holding member 3 that are disposed facing the punch 1. The die block 2 and the holding member 3 are constructed so as to be movable in such directions as to move closer to and apart from the punch 1 (up-down directions in FIG. 3), and so that the workpiece 50 can be supported by the holding member 3 and the punch 1 clamping the workpiece 50.

The punch 1 has a top plate-forming portion 1*a* that corresponds to a portion that forms the top plate 51 of the final formed article 5, a first side plate-forming portion 1*b* that corresponds to a portion that forms the first side plate 52, and a flat surface portion-forming portion 1*d* that corresponds to a portion that forms the flat surface portion 54. The flat surface portion-forming portion 1*d* is disposed between the top plate-forming portion 1*a* and the first side plate-forming portion 1*b*. A protruded angle portion 1*p* is formed between the top plate-forming portion 1*a* and the flat surface portion-forming portion 1*d*, and a protruded angle portion 1*q* is formed between the first side plate-forming portion 1*b* and the flat surface portion-forming portion 1*d*.

Besides, the die block 2 has a first side plate-forming portion 2*b* that corresponds to a portion that forms the first side plate 52, and a flat surface portion-forming portion 2*d* that corresponds to a portion that forms the flat surface portion 54. Then, by moving the die block 2 to the punch 1 side, the workpiece 50 clamped between the holding member 3 and the punch 1 is pressurized while the workpiece 50 is tightly sandwiched (pressed) between the die block 2 and the punch 1, so that the final formed article 5 can be formed by bending the workpiece 50. Besides, the workpiece 50 can also be bent by pressing the die block 2 against the workpiece 50 clamped between the holding member 3 and the punch 1 in the course of moving the die block 2 toward the punch 1.

Figure 4:
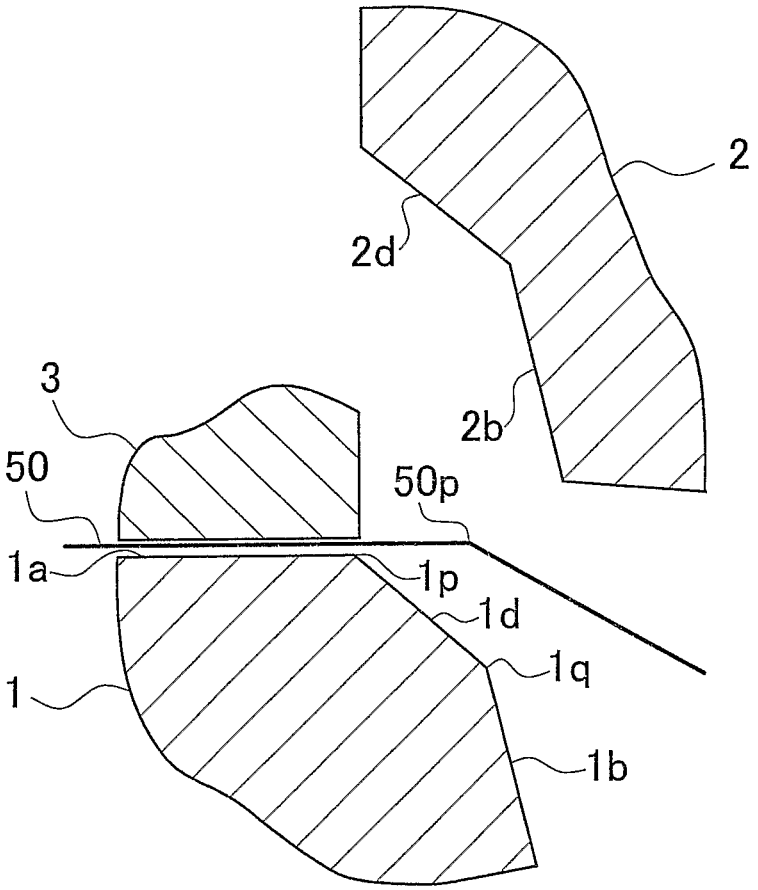
FIG. 4 is a side sectional view of a bending apparatus that cantilevers a workpiece by a punch and a holding member.

By the bending apparatus constructed as described above, the workpiece 50 is bent in the following manner so as to form the final formed article 5. Firstly, in order to perform a bending process on the workpiece 50, a workpiece holding process of supporting the workpiece 50 by clamping it between the holding member 3 and the punch 1 is carried out while the punch 1 and the die block 2 are apart from each other as shown in FIG. 4. In this case, the workpiece 50 corresponding to the portion that extends from the top plate 51 to the first side plate 52 is cantilevered at a first end portion thereof (a left-side end portion in FIG. 4, that is, a portion that is formed into the top plate 51) by the holding member 3 and the punch 1, and a second end portion of the workpiece 50 (a right-side end portion in FIG. 4, that is, a portion that is formed into the first side plate 52) is a free end that is not constrained.

Besides, in the workpiece 50 cantilevered by the holding member 3 and the punch 1, a preliminary bend portion 50*p* that serves as a bent portion that is bent in the same direction as the first bend portion 54*a* and the second bend portion 54*b* is formed beforehand in an area in the workpiece 50 which corresponds to the flat surface portion 54 of the first inclined area 5*a* in the final formed article 5. That is, in the workpiece 50 that is subjected to the bending process by a bending apparatus of this embodiment, the preliminary bend portion 50*p* bent in the same direction as the first bend portion 54*a* and the second bend portion 54*b* is formed beforehand in a process earlier than the bending process. The workpiece 50 is cantilevered by the holding member 3 and the punch 1, with the preliminary bend portion 50*p* being positioned at a location that corresponds to the flat surface portion-forming portion 1*d* of the punch 1. The flat surface portion-forming portion 1*d* is a portion that forms the flat surface portion 54 of the workpiece 50.

Figure 5:
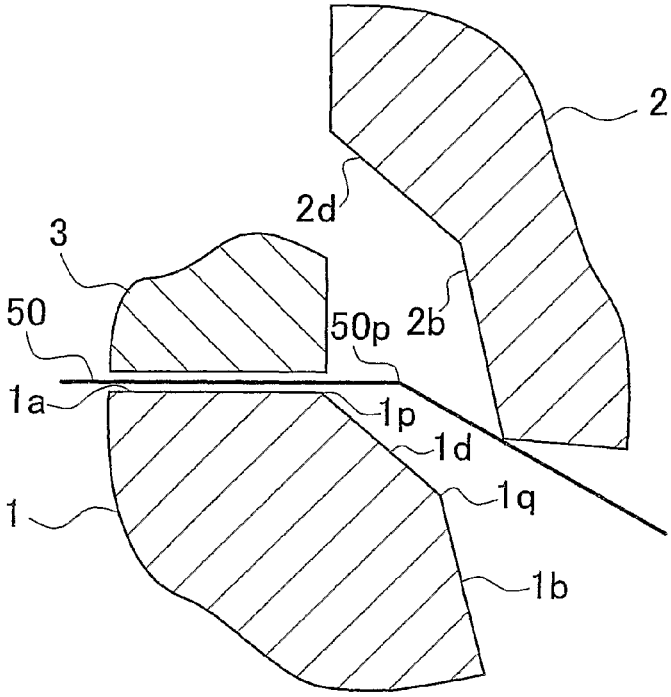
FIG. 5 is a side sectional view of the bending apparatus, showing a state in which the die block has been moved to the punch side, and the die block is in contact with a portion of the workpiece near a second end that is remote from the punch.

Next, while the workpiece 50 is cantilevered by the holding member 3 and the punch 1, a forming process of moving the die block 2 to the punch 1 side (in a direction of approach to the punch 1), and pressing the second end side of the workpiece 50 to the punch 1 side by the die block 2, and causing the die block 2 to press the workpiece 50 to the punch 1. As shown in FIG. 5, as the die block 2 is moved to the punch 1 side in the forming process, a lower end portion of the die block 2 first contacts the workpiece 50.

Figure 6:
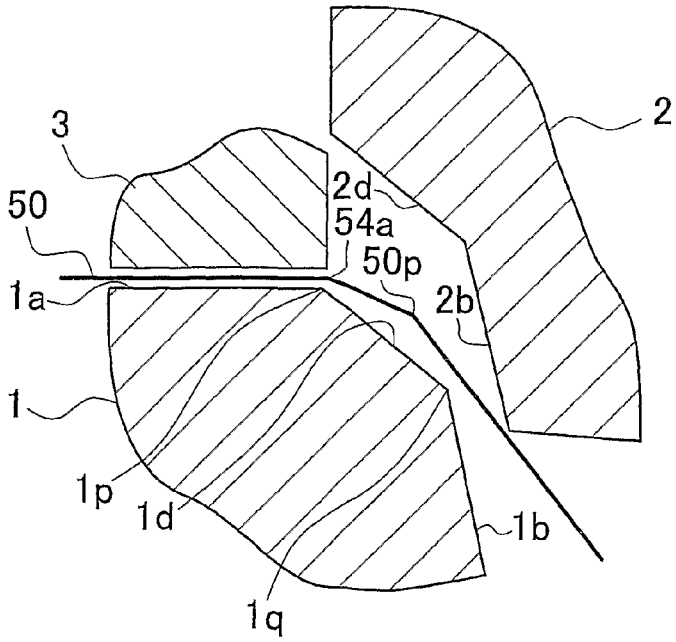
FIG. 6 is a side sectional view of the bending apparatus, showing a state in which the workpiece has been bent at an angle portion of the punch between a top plate-forming portion and a flat surface portion-forming portion so as to form a first bend portion, by pressing the workpiece by the die block after the die block has contacted the second end side of the work.
Figure 7:
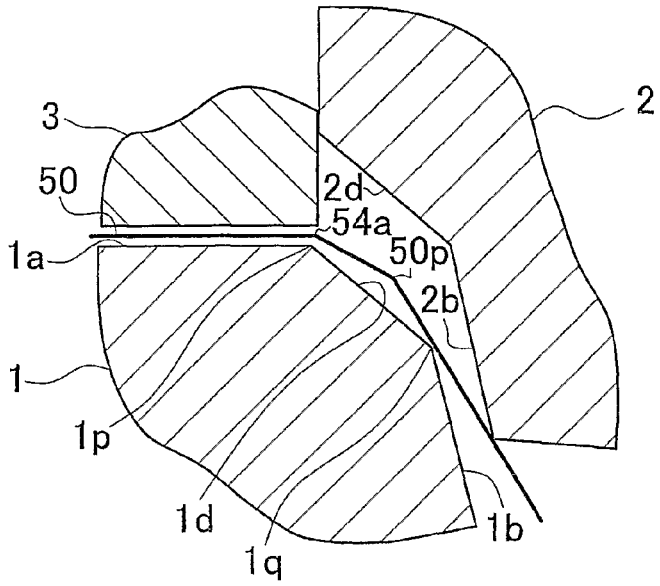
FIG. 7 is a side sectional view of the bending apparatus, showing a state in which the workpiece has been pressed further toward the punch, and the workpiece is in contact with the angle portion between the flat surface portion-forming portion and a first side plate-forming portion of the punch.

As shown in FIG. 6, after the die block 2 contacts the workpiece 50, the workpiece 50, whose preliminary bend portion 50*p* is disposed in a range subject to the flat surface portion-forming portion 1*d*, is pressed to the punch 1 side by the die block 2, so that the workpiece 50 is bent at the angle portion 1*p* between the top plate-forming portion 1*a* and the flat surface portion-forming portion 1*d*, thus forming the first bend portion 54*a* at a position in the workpiece 50 that corresponds to the angle portion 1*p* of the punch 1.

After that, as the die block 2 is further moved to the punch 1 side, the workpiece 50 is further pressed to the punch 1 side by the die block 2, and the workpiece 50 contacts the angle portion 1*q* between the flat surface portion-forming portion 1*d* and the first side plate-forming portion 1*b* of the punch 1. Besides, since the workpiece 50 is pressed to the punch 1 side by the die block 2, an area in the workpiece 50 that corresponds to the flat surface portion-forming portion 1*d* of the punch 1 is curved and therefore flexed to the same side as the preliminary bend portion 50*p* is bent. Incidentally, at the time point when the workpiece 50 contacts the angle portion 1*q*, a portion of the workpiece 50 that includes the preliminary bend portion 50*p* and that faces the flat surface portion-forming portion 1*d* of the punch 1 is not in contact with the flat surface portion-forming portion 2*d* of the die block 2. That is, at this time point, the flat surface portion-forming portion 2*d* of the die block 2 does not yet press the workpiece 50 to the flat surface portion-forming portion 1*d* of the punch 1.

Figure 8:
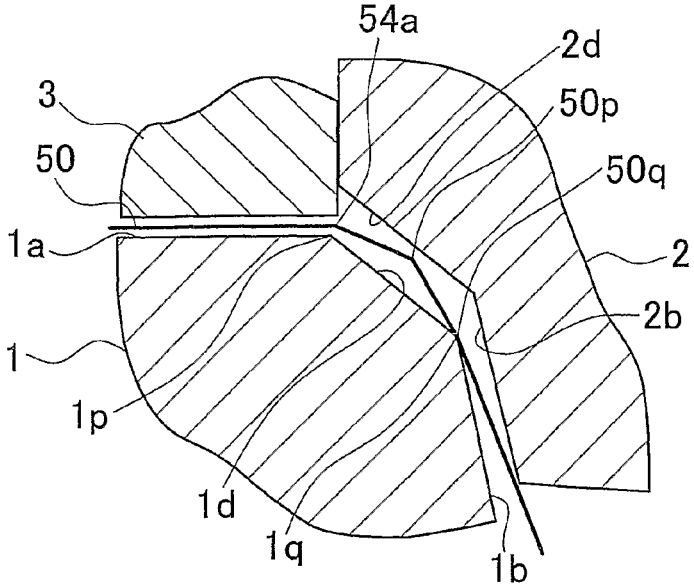
FIG. 8 is side sectional view of the bending apparatus, showing a state in which after the workpiece has contacted the angle portion between the flat surface portion-forming portion and the first side plate-forming portion, the workpiece is pressed further to the punch side by the die block so that the workpiece is bent at the angle portion and thus a stabilized bend portion is formed.

Furthermore, as shown in FIG. 8, after the workpiece 50 contacts the angle portion 1*q* between the flat surface portion-forming portion 1*d* and the first side plate-forming portion 1*b*, the workpiece 50 is pressed further to the punch 1 side by the die block 2, so that the workpiece 50 is bent at the angle portion 1*q*, forming a stabilized bend portion 50*q*. The bend direction of the stabilized bend portion 50*q* is the same as the direction of the bending of the first bend portion 54*a* and the second bend portion 54*b* of the workpiece 50 that is performed later. Besides, the stabilized bend portion 50*q* of the workpiece 50 is plastically deformed, so that the bent state thereof is maintained as a stabilized bend even after the pressed state caused by the die block 2 is discontinued.

Incidentally, during the state in which the workpiece 50 has been bent at the angle portion 1*q* but has not been pressed between the punch 1 and the die block 2 as shown in FIG. 8, a portion of the workpiece 50 that faces the flat surface portion-forming portion 1*d* does not extend along the flat surface portion-forming portion 1*d*, but is curved by the pressing of the workpiece 50 by the preliminary bend portion 50*p* formed in the flat surface portion-forming portion 1*d* of the punch 1 and by the die block 2, and is thus flexed so that the aforementioned portion of the workpiece 50 present in the range between the angle portion 1*p* and the angle portion 1*q* is off from the flat surface portion-forming portion 1*d*. Besides, the stabilized bend portion 50*q* of the workpiece 50, and the curved portion of the workpiece 50 that faces the flat surface portion-forming portion 1*d* are plastically deformed, so that the bent state and the curved state thereof are maintained as a stabilized bent state even after the pressed state caused by the die block 2 is discontinued.

Figure 9:
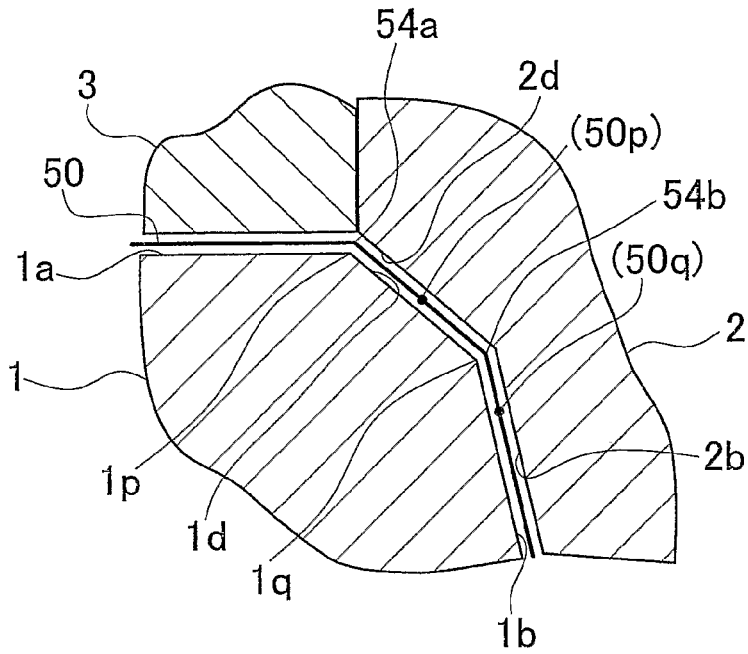
FIG. 9 is a side sectional view of the bending apparatus, showing a state in which a final formed article is formed by pressing the workpiece by the punch and the die block.

Thus, in the forming process, before the workpiece 50 is pressed between the punch 1 and the die block 2 by moving the die block 2 to the punch 1 side and thereby pressing the workpiece 50, the portion of the workpiece 50 that includes the preliminary bend portion 50*p* and that corresponds to the flat surface portion-forming portion 1*d* of the punch 1 is curved and flexed, thus forming the stabilized bend portion 50*q*. After that, as shown in FIG. 9, the workpiece 50 is pressed further toward the punch 1 side by the die block 2 so that the die block 2 press the workpiece 50 to the punch 1.

Concretely, the workpiece 50 clamped by the top plate-forming portion 1*a* of the punch 1 and the holding member 3 is pressed between the flat surface portion-forming portion 1*d* of the punch 1 and the flat surface portion-forming portion 2*d* of the die block 2, and between the first side plate-forming portion 1*b* of the punch 1 and the first side plate-forming portion 2*b* of the die block 2, so that the workpiece 50 is bent at the angle portion 1*p* and the angle portion 1*q*. Thus, the first bend portion 54*a* is formed at a position in the workpiece 50 that corresponds to the angle portion 1*p*, and the second bend portion 54*b* is formed at a position in the workpiece that corresponds to the angle portion 1*q*.

Thus, by pressing the workpiece 50 between the punch 1 and the die block 2 whose shapes correspond to the shape of the first inclined area 5*a* of the final formed article 5, the first bend portion 54*a* and the second bend portion 54*b* are formed. As a result, the top plate 51, the first side plate 52, and the flat surface portion 54 are formed in the workpiece 50. In this manner, the final formed article 5 is formed. Incidentally, the state in which the workpiece 50 is pressed between the punch 1 and the die block 2 is the bottom dead center of the die block 2 (i.e., the position at which the punch 1 and the die block 2 are the closest to each other).

In this case, the preliminary bend portion 50*p* formed beforehand in a portion of the workpiece 50 that corresponds to the flat surface portion-forming portion 1*d*, and the flexure caused by the curvature of the workpiece 50 are pressed to be unbent between the flat surface portion-forming portion 1*d* of the punch 1 and the flat surface portion-forming portion 2*d* of the die block 2, and are thus temporarily made flat. Besides, before the workpiece 50 is pressed between the punch 1 and the die block 2, the stabilized bend portion 50*q* formed in a portion of the workpiece 50 that corresponds to the angle portion 1*q* is unbent to become flat as the preliminary bend portion 50*p* and the flexure caused by the curvature of the workpiece 50 are pressed between the punch 1 and the die block 2, so that the stabilized bend portion 50*q* moves from the angle portion 1*q* of the punch 1 to the first side plate-forming portion 1*b* side.

That is, since the portion of the workpiece 50 that is located to the top plate-forming portion 1*a* side of the flat surface portion-forming portion 1*d* is clamped by the punch 1 and the holding member 3, and is therefore fixed in position, a flexed portion of the workpiece 50 that is in the range that is subject to the flat surface portion-forming portion 1*d* is squeezed to become flat by the pressing between the punch 1 and the die block 2, so that the surplus or slack portion of the workpiece 50 located in the range of the flat surface portion-forming portion 1*d* is forced out to the first side plate-forming portion 1*b* side. Thus, the stabilized bend portion 50*q* moves from a location corresponding to the angle portion 1*q* to the first side plate-forming portion 1*b* side. Besides, the stabilized bend portion 50*q* having moved to the first side plate-forming portion 1*b* side is pressed between the first side plate-forming portion 1*b* of the punch 1 and the first side plate-forming portion 2*b* of the die block 2, and is therefore unbent to become flat on a temporarily basis.

Figure 10:
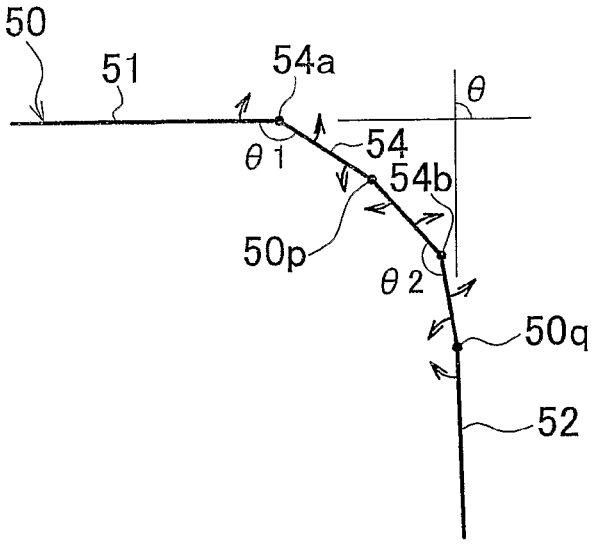
FIG. 10 is a side view showing how spring-back occurs in a first bend portion and a second bend portion, and how spring-go occurs in a preliminary bend portion and the stabilized bend portion.

After the workpiece 50 is pressed and formed between the punch 1 and the die block 2 in the foregoing manner, the die block 2 is moved in such a direction as to move apart from the punch 1, and then the formed workpiece 50 is released from the die device. As shown in FIG. 10, after the workpiece 50 is released from the die device, the first bend portion 54*a* and the second bend portion 54*b* bent by the pressing between the punch 1 and the die block 2 undergo spring-back due to the material strength of the workpiece 50.

It is to be noted herein that the spring-back that occurs in the workpiece 50 refers to a phenomenon that the inside bend angles 01, 02 of the first bend portion 54*a* and the second bend portion 54*b* formed by pressing the workpiece 50 between the punch 1 and the die block 2 change in a direction of increase when the workpiece 50 is released from the die device. That is, the spring-back is a phenomenon that the first bend portion 54*a* and the second bend portion 54*b* formed by bending the workpiece 50 through the use of the punch 1 and the die block 2 are slightly unbent in such a direction as to flatten, after the workpiece 50 is released from the die device. Due to the spring-back that occurs in the workpiece 50, the angle θ formed by the top plate 51 and the first side plate 52 of the workpiece 50 changes in the direction of increase.

On the other hand, in the stabilized bend portion 50*q* of the workpiece 50, and the area in the workpiece 50 that corresponds to the flat surface portion 54 of the first inclined area 5*a* that includes the preliminary bend portion 50*p* of the workpiece 50, which are unbent during the forming process in which the workpiece 50 is pressed between the punch 1 and the die block 2, spring-go appears when the workpiece 50 is released from the die device, and is therefore released from the constraint imposed by the punch 1 and the die block 2. It is to be noted herein that in the preliminary bend portion 50*p*, the area in the workpiece 50 that corresponds to the flat surface portion 54, and the stabilized bend portion 50*q* which have been pressed between the punch 1 and the die block 2 to become flat, a reaction force remains, so that when the pressed state imposed by the punch 1 and the die block 2 is discontinued, the remaining reaction force appears. Thus, the stabilized bend portion 50*q* of the workpiece 50, and the area in the workpiece 50 that corresponds to the flat surface portion 54 of the first inclined area 5*a* that includes the preliminary bend portion 50*p* assume a bent state again. This phenomenon is referred to as the spring-go that appears in the workpiece 50.

As described above, as the spring-go appears in the stabilized bend portion 50*q* and the area in the workpiece 50 that corresponds to the flat surface portion 54 of the first inclined area 5*a* that includes the preliminary bend portion 50*p*, the once-flattened preliminary bend portion 50*p*, the once-flattened curved and flexed area in the workpiece 50 that corresponds to the flat surface portion 54, and the once-flattened stabilized bend portion 50*q* regain a bent state. Therefore, the angle θ formed between the top plate 51 and the first side plate 52 of the workpiece 50 changes in the direction of decrease, due to the spring-go that occurs in the workpiece 50.

Thus, when the workpiece 50 is released from the die device, the spring-back occurs in the first bend portion 54*a* and the second bend portion 54*b*, and therefore changes the angle θ formed between the top plate 51 and the first side plate 52 of the workpiece 50 in the direction of increase, whereas the spring-go that changes the angle θ between the top plate 51 and the first side plate 52 of the workpiece 50 in the direction of decrease occurs in the stabilized bend portion 50*q* and the area in the workpiece 50 that corresponds to the surface portion 54 of the first inclined area 5*a* that includes the preliminary bend portion 50*p*. Hence, the change in the angle θ caused by the spring-back is offset by the change in the angle θ caused by the spring-go, and thus the change in the angle θ before and after the die release can be restrained. Therefore, it becomes unnecessary to take into account the amount of spring-back of the workpiece 50 in the construction of the forming die device that includes the punch 1 and the die block 2 as in the related art, and it becomes possible to use the dimensions of the final formed article 5.

The amounts of spring-back that occur in the first bend portion 54*a* and the second bend portion 54*b*, and the amounts of spring-go that occur in the stabilized bend portion 50*q* and the area that corresponds to the flat surface portion 54 of the first inclined area 5*a* that include the preliminary bend portion 50*p* change according to the chamfer shape of first inclined area 5*a* that is defined by the predetermined width W and the predetermined height H shown in FIG. 2. Therefore, by adjusting the chamfer shape of the first inclined area 5*a*, the total of amounts of spring-back and the total of amounts of spring-go that occur in the workpiece 50 can be made equal, whereby the dimensional accuracy of the final formed article 5 can be heightened.

Besides, the amount of spring-back and the amount of spring-go that occur in the workpiece 50 are each proportional to the material strength of the workpiece 50. Therefore, as long as adjustment is made so as to equalize the amount of spring-back and the amount of spring-go that occur in the workpiece 50, good dimensional accuracy of the final formed article 5 can be secured even if the material strengths of workpieces 50 vary, since the amounts of spring-back and spring-go that occur in the workpiece 50 increase or decrease according to the magnitude of the material strength. In this case, even in the case of a workpiece 50 having a high material strength of 980 MPa or higher, good dimensional accuracy of the final formed article 5 can be secured, as in the case of a workpiece 50 having a material strength of 980 MPa or less.

In particular, in this embodiment, the preliminary bend portion 50*p* that undergoes spring-go is formed beforehand in the workpiece 50, and the preliminary bend portion 50*p* is disposed in an area that corresponds to the flat surface portion 54 of the first inclined area 5*a*, prior to the bending process by the bending apparatus, during which the area that corresponds to the flat surface portion 54 of the first inclined area 5*a* of the workpiece 50 is curved. Therefore, the spring-back that occurs in the first inclined area 5*a* can be sufficiently offset by the spring-go that occurs in the preliminary bend portion 50*p*, and the portion of the workpiece 50 that is flexed due to the curvature of the area that corresponds to the flat surface portion 54 (i.e., the area in the workpiece 50 that corresponds to the flat surface portion 54 of the first inclined area 5*a* that includes the preliminary bend portion 50*p*), so that a final formed article 5 with high dimensional accuracy can be formed.

The spring-back that occurs in the workpiece 50 can also be reduced by utilizing only the spring-go that occurs in the flat surface portion 54 of the first inclined area 5*a* that includes the preliminary bend portion 50*p*. However, in the foregoing embodiment, the stabilized bend portion 50*q* is formed in the first side plate 52, in addition to the preliminary bend portion 50*p*, and the spring-go that occurs in the stabilized bend portion 50*q* is also utilized, so that the spring-back that occurs in the workpiece 50 can be reduced and therefore the dimensional accuracy of the final formed article 5 can be improved.

In this embodiment, the stabilized bend portion 50*q* is formed before the first bend portion 54*a* and the second bend portion 54*b* are formed by pressing the workpiece 50 between the punch 1 and the die block 2, the warp that occurs in the first side plate 52 (a vertical wall portion of the hat-like sectional shape) with which the die block 2 has a sliding contact can be restrained. Hence, the dimensional accuracy of the final formed article 5 can be improved.

Figure 11:
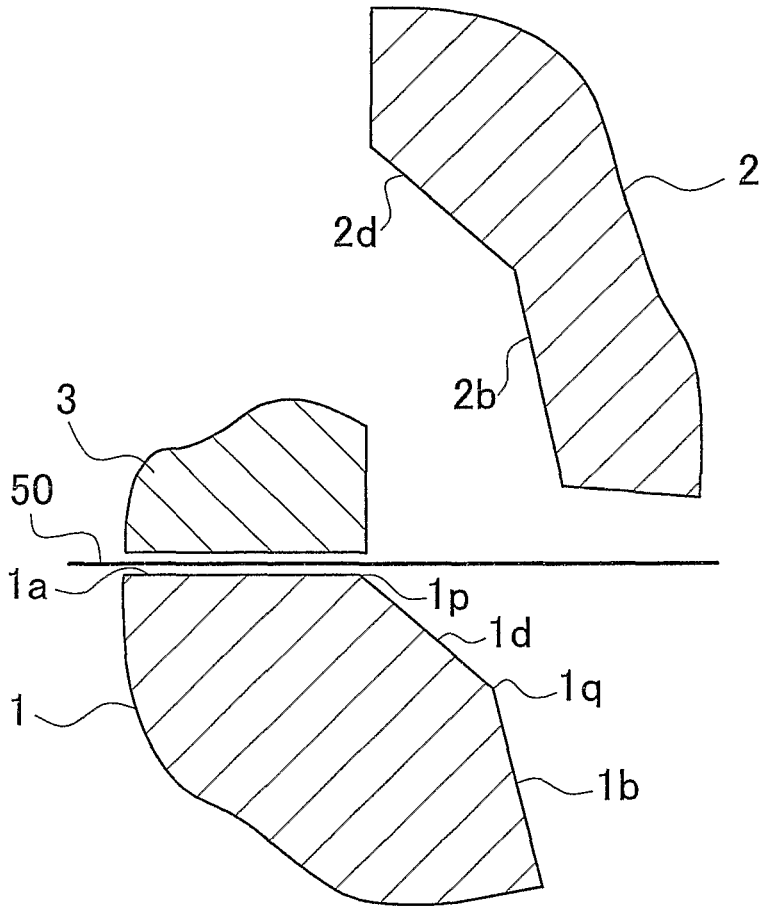
FIG. 11 is a side sectional view of the bending apparatus, showing a state in which a workpiece without a preliminary bend portion is cantilevered.

Besides, although in this embodiment, the preliminary bend portion 50*p* is formed beforehand, the final formed article 5 can also be formed by using a workpiece 50 in which a preliminary bend portion 50*p* is not formed beforehand. In this case, as shown in FIG. 11, firstly in a workpiece holding process, an end portion of the workpiece 50 is clamped and thus cantilevered by the punch 1 and the holding member 3 that is disposed facing the punch 1.

Figure 12:
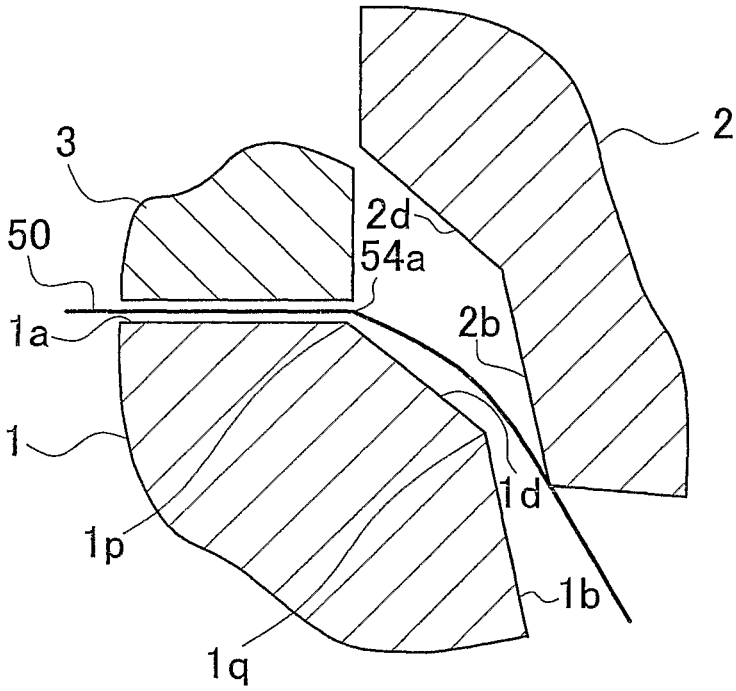
FIG. 12 is a side sectional view of the bending apparatus, showing a state in which a workpiece without a preliminary bend portion is bent at the angle portion of the punch between a top plate-forming portion and the flat surface portion-forming portion so as to form the first bend portion by pressing the workpiece with the die block.
Figure 13:
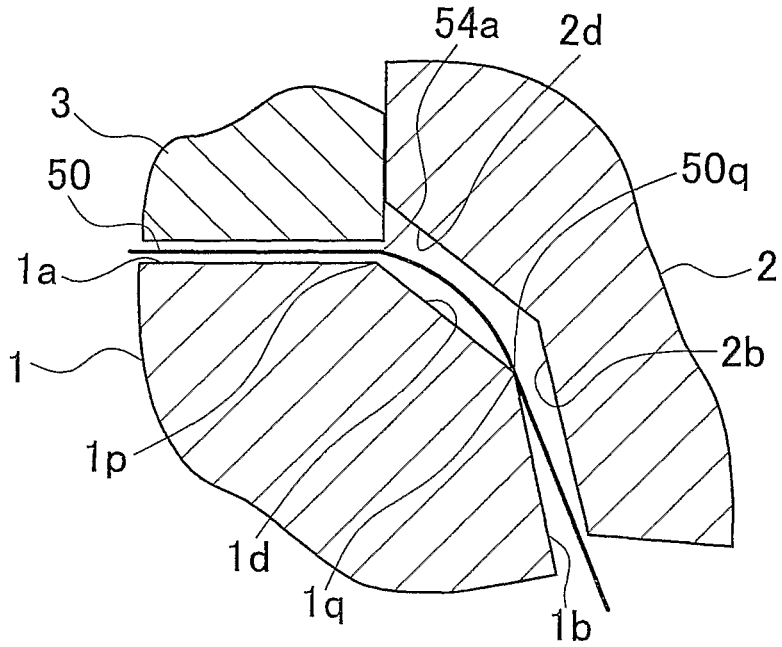
FIG. 13 is a side sectional view of the bending apparatus, showing a state in which the workpiece without a preliminary bend portion is brought into contact with the angle portion between the flat surface portion-forming portion and the first side plate-forming portion, and is then pressed to the punch side, so that the workpiece is bent at the angle portion to form a stabilized bend portion, and the portion of the workpiece located at the flat surface portion-forming portion is curved.

Next, in a forming process, the die block 2 is moved to the punch 1 side so that, as shown in FIG. 12, the die block 2 contacts the workpiece 50, and presses the workpiece 50 to the punch 1 side. Therefore, the workpiece 50 is bent at the angle portion 1*p*, so as to form the first bend portion 54*a* at a position that corresponds to the angle portion 1*p* of the workpiece 50. After that, as the die block 2 is moved further to the punch 1 side, the workpiece 50 is pressed further to the punch 1 side by the die block 2 as shown in FIG. 13, so that the workpiece 50 contacts the angle portion 1*q* of the punch 1, and is thereby bent. Thus, the stabilized bend portion 50*q* is formed.

At the time point at which the workpiece 50 contacts the angle portion 1*q* and is thereby bent, the workpiece 50 is not pressed tightly between the die block 2 and the punch 1, but a portion of the workpiece 50 that faces the flat surface portion-forming portion 1*d* does not extend along the flat surface portion-forming portion 1*d*, but is in a curved and flexed state in which the aforementioned portion of the workpiece 50 present in the range between the angle portion 1*p* and the angle portion 1*q* is off from the flat surface portion-forming portion 1*d*. After that, the workpiece 50 is pressed further to the punch 1 side by the die block 2, and is pressed tightly between the punch 1 and the die block 2. Thus, the final formed article 5 is formed.

As described above, before the workpiece 50 is pressed between the die block 2 and the punch 1, the portion of the workpiece 50 that faces the flat surface portion-forming portion id (the flat surface portion 54 of the first inclined area 5*a* of the workpiece 50) is curved and therefore flexed, and the workpiece 50 is brought into contact with the angle portion 1*q* of the punch 1 so as to form the stabilized bend portion 50*q* in the workpiece 50. Besides, when the workpiece 50 is pressed between the die block 2 and the punch 1 after the portion of the workpiece 50 positioned in the range of the flat surface portion-forming portion id is curved and the stabilized bend portion 50*q* is formed in the portion, the curved and flexed portion of the workpiece 50 subject to the flat surface portion-forming portion 1*d* is unbent. Therefore, when the final formed article 5 is released from the die device, the spring-go that occurs in the portion of the final formed article 5 that corresponds to the flat surface portion-forming portion 1*d* lessens the spring-back that occurs in the first inclined area 5*a* of the final formed article 5.

Besides, the spring-back that occurs in the workpiece 50 can be more certainly reduced by also utilizing the spring-go that occurs in the stabilized bend portion 50*q* formed in the first side plate 52, so that further improvement of the dimensional accuracy of the final formed article 5 is possible.

Next described will be an embodiment in which the bend angle θa and the bend angle θb of the second inclined area 5*b* are controlled by changing the chamfered shape of the first inclined area 5*a* and the second inclined area 5*b* of the final formed article 5 in various manners. The bend angle θa and the bend angle θb in this embodiment are angles that are formed in the case where the final formed article 5 is formed in a condition that the preliminary bend portion 50*p* formed in the workpiece 50 is disposed at the position of an intersection point A between imaginary extensions of the top plate-forming portion 1*a* and the first side plate-forming portion 1*b* of the punch 1.

Figure 15:
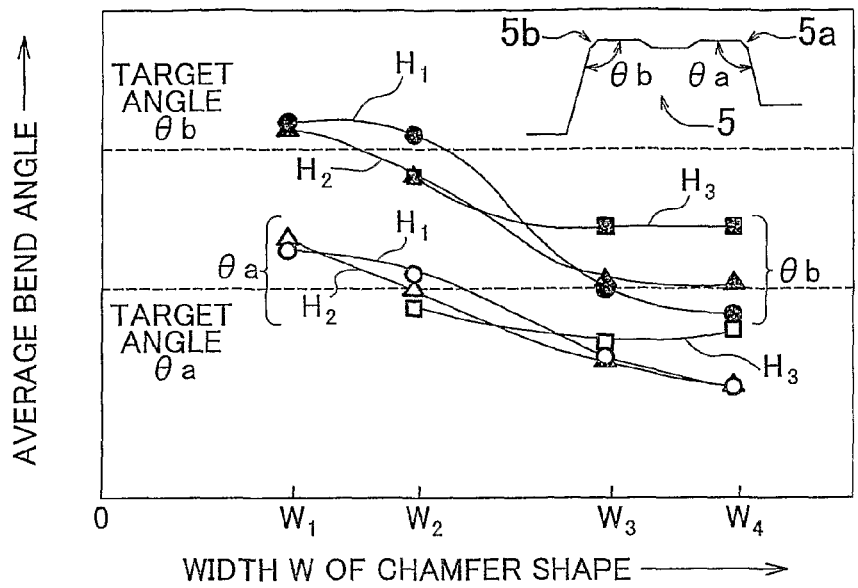
FIG. 15 is a diagram showing the bend angle of the first bend portion and the bend angle of the second bend portion in the case where the height of the chamfer shape of each of the first bend portion and the second bend portion is set at a plurality of values, and the width thereof is variously set for each of the set values of the height.

FIG. 15 shows values of the bend angle θa of the first inclined area 5*a* and values of the bend angle θb of the second inclined area 5*b* that are obtained when the height H of the chamfer shape of the first inclined area 5*a* and of the second inclined area 5*b* is set at $H_1$, $H_2$ and $H_3$ ($H_1<H_2<H_3$) and the width W thereof is variously set at $W_1$, $W_2$, $W_3$ and $W_4$ ($W_1>W_2>W_3>W_4$) for each of the set heights $H_1$, $H_2$ and $H_3$.

As shown in FIG. 15, the bend angle θa and the bend angle θb can be changed by varying the chamfer shape (the height H and the width W). Therefore, by appropriately selecting the height H and the width W, the bend angle θa and the bend angle θb can be controlled so as to be equal to their target values.

In this embodiment, the bend angle θb was brought equal to the targeted angle value by setting the height at $H_2$, and the width at $W_2$. Furthermore, the bend angle θa can be brought approximately to the targeted angle in the case where the height is set at $H_1$ and the width is set at $W_2$, and the case where the height is set at $H_3$ and the width is set at $W_2$.

The bend angle θb was brought closest to the targeted angle in the case where the height was set at $H_3$ and the width was set at $W_2$. Furthermore, the bend angle θa can also be brought approximately to the target angle in the case where the height is set at $H_1$ and the width is set at $W_2$, and the case where the height is set at $H_2$ and the width is set at $W_2$.

Figure 14:
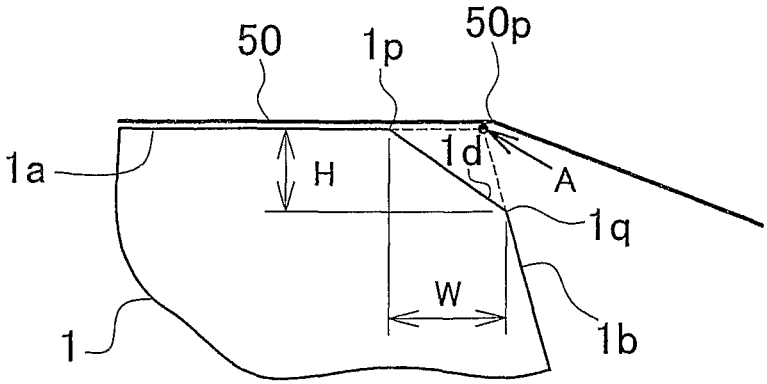
FIG. 14 is a side view of the bending apparatus, showing a state in which the preliminary bend portion formed in the workpiece is disposed at the position of an intersection point between imaginary extensions of the top plate-forming portion and the first side plate-forming portion of the punch.

Next, with regard to the bend angles θa, θb obtained when the final formed article 5 is formed in a condition that the preliminary bend portion 50*p* formed in the workpiece 50 is disposed at the position of the intersection point A between imaginary extensions of the top plate-forming portion 1*a* and the first side plate-forming portion 1*b* of the punch 1 as shown in FIG. 14, relations of the degrees of change in the bend angles θa, θb (the amount of spring-back) (hereinafter, referred to as "degree of change in the bend angles θa, θb") with the chamfer shapes of the first inclined area 5*a* and the second inclined area 5*b* of the final formed article 5 will be described.

Figure 16:
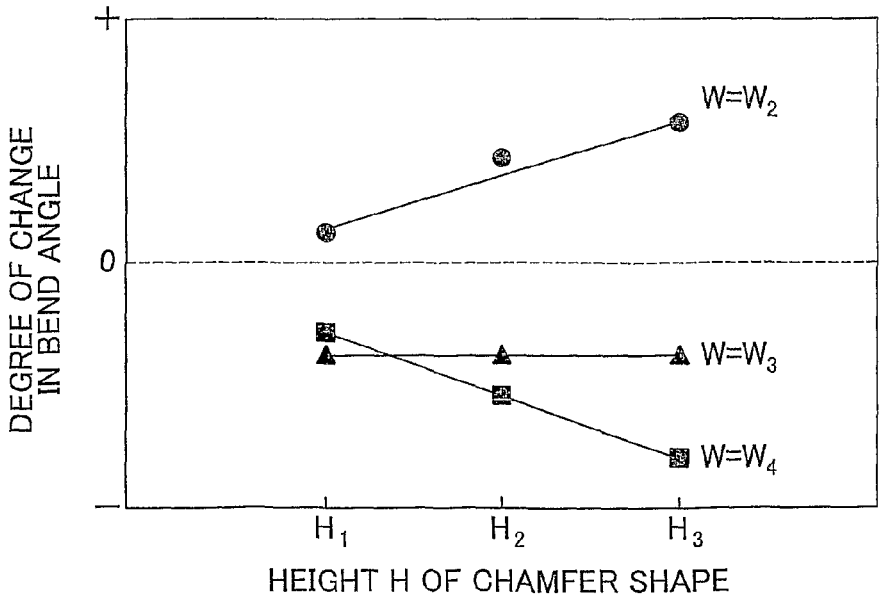
FIG. 16 is a diagram showing degrees of change in the bend angles of the first inclined area and the second inclined area in the case where the width of the chamfer shape of the first inclined area and the second inclined area is set at a plurality of values and the height thereof is variously set for each of the set widths.

FIG. 16 shows degrees of change in the bend angles θa, θb in the case where the width of the chamfer shape of the first inclined area 5*a* and the second inclined area 5*b* is set at $W_2$, $W_3$ and $W_4$ and the height thereof is variously set at $H_1$, $H_2$ and $H_3$ for each of the set widths $W_2$, $W_3$ and $W_4$.

As shown in FIG. 16, the values of the degree of change in the bend angles θa, θb can be varied by changing the chamfer shape (the height H and the width W). Therefore, the degree of change in the bend angles θa, θb can be controlled so as to become small by appropriately selecting the height H and the width of the chamfer shape.

In this example, the degree of change in the bend angles θa, θb becomes the smallest (closes to zero) in the case where the height is set at $H_1$ and the width is set at $W_2$. Furthermore, the degree of change in the bend angles θa, θb can be made small also in the case where the height is set at $H_1$ and the width is set at $W_3$, or in the case where the height is set at $H_1$ and the width is set at $W_4$.

Next described will be an example in which the magnitudes of the bend angle θa and the bend angle θb are controlled by changing the position of the preliminary bend portion 50*p* formed in the workpiece 50. In this example, the magnitudes of the bend angle θa and the bend angle θb are controlled by adjusting the position at which the preliminary bend portion 50*p* is formed, in a condition that the chamfer shape of each of the first inclined area 5*a* and the second inclined area 5*b* (the height H and the width W) is set to a predetermined shape.

Figure 17:
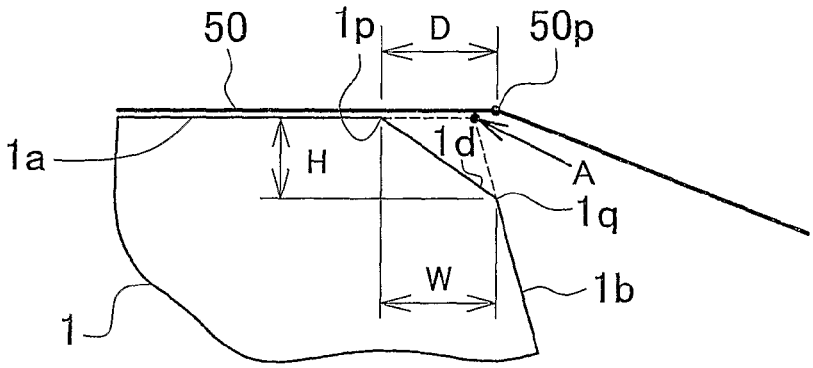
FIG. 17 is a side view showing an offset dimension that is measured, on the workpiece, from the position corresponding to the angle portion between the top plate-forming portion and the flat surface portion-forming portion of the punch to the position at which the preliminary bend portion is formed.

Besides, as shown in FIG. 17, the position of formation of the preliminary bend portion 50*p* is represented by an offset dimension D that is measured, on the workpiece 50, from the position corresponding to the angle portion 1*p* between the top plate-forming portion 1*a* and the flat surface portion-forming portion 1*d* of the punch 1 to the position of formation of the preliminary bend portion 50*p*. By changing this offset dimension D, the magnitudes of the bend angle θa and the bend angle θb are controlled.

Figure 18:
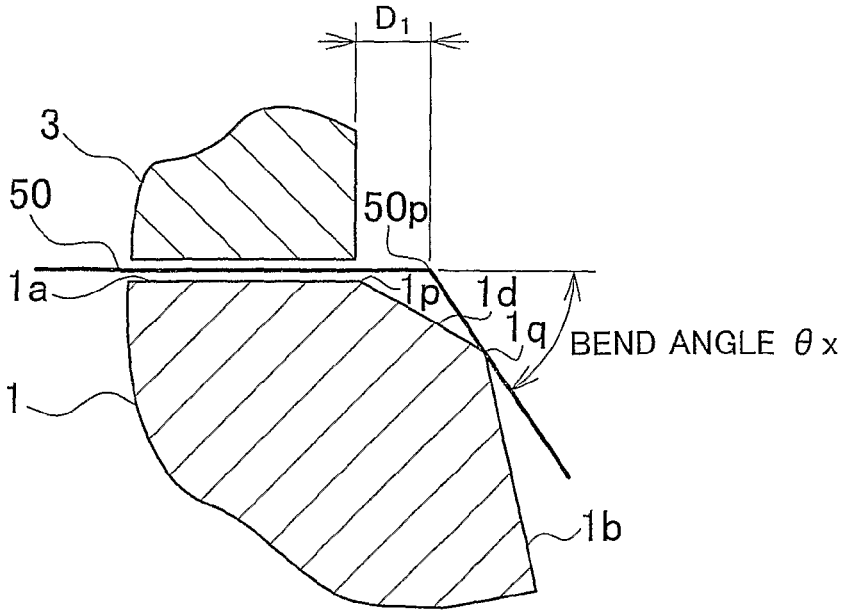
FIG. 18 is a side sectional view showing a maximum bend angle of the preliminary bend portion of the workpiece in the case where the offset dimension is set at a predetermined angle in the range subject to the flat surface portion-forming portion.

In that control, the bend angle of the preliminary bend portion 50*p* can be set at an appropriate angle within an upper limit that is the bend angle at which the workpiece 50 contacts the angle portion 1*q* of the punch 1 in the stage of the workpiece holding process in which the workpiece 50 is cantilevered. Besides, the offset dimension D needs to be set so that the preliminary bend portion 50*p* is within the range subject to the flat surface portion-forming portion 1*d* of the punch 1, and it is desirable that the offset dimension D be adjusted in the workpiece holding process, within such a limit range that the workpiece 50 contacts the angle portion 1*q* of the punch 1 in the stage of the work holding process. For example, in the case where the offset dimension D is set at $D_1$ within the range subject to the flat surface portion-forming portion 1*d* as shown in FIG. 18, the maximum value of the bend angle Ox of the preliminary bend portion 50*p* occurs in the case where the workpiece 50 contacts the angle portion 1*q* of the punch 1 in the stage of the workpiece holding process.

Figure 19:
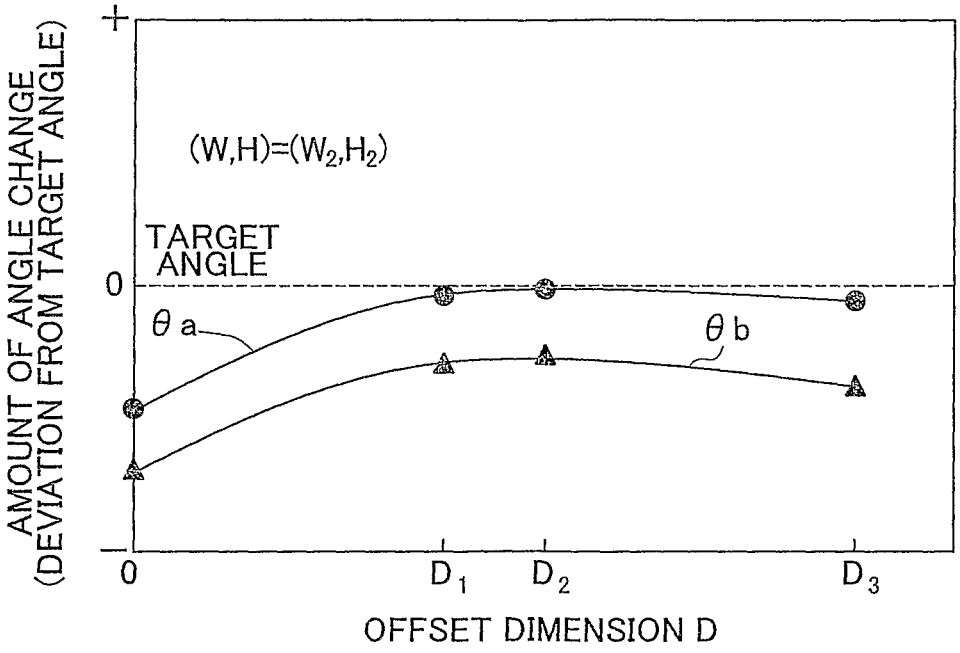
FIG. 19 is a diagram showing the amounts of change in the first bend angle and the second bend angle (deviations from the target angle) that occur at various values of the offset dimension D extending to the preliminary bend portion of the workpiece in a condition that the chamfer shape of each of the first bend portion and the second bend portion is set to a predetermined chamfer shape.

FIG. 19 shows the amounts of change in the bend angle θ*a* and the bend angle θb (deviations from the target angle) that occur at various values of the offset dimension D in a condition that the height H is set at $H_2$, the width W is set at $W_2$, and the chamfer shape of each of the first inclined area 5*a* and the second inclined area 5*b* is a predetermined chamfer shape. In FIG. 19, the amounts of change in angle corresponding to the range of the offset dimension D from 0 to $D_3$ are shown, that is, the amount of change in angle changes to the plus side while the offset dimension D changes from 0 to $D_1$, and further changes to the plus side until the offset dimension D reaches $D_2$. As the offset dimension D changes from $D_2$ to $D_3$, the amount of change in angle slightly changes to the minus side.

Thus, since the amounts of change in the bend angle θ*a* and the bend angle θb from the target angle can be controlled by changing the offset dimension D, it is possible to obtain a desired amount of change in the angle by adjusting the offset dimension D.

For example, in the case where the amount of spring-back that is caused by the forming die device that includes the punch 1 and the die block 2 is offset by the amount of spring-go that occurs in the preliminary bend portion 50*p*, a final formed article 5 that has exactly the target angles can be formed highly accurately by performing the forming of the final formed article 5 with the offset dimension being set at the value $D_2$ at which the amount of change in angle becomes substantially zero, as in the bend angle θa shown in FIG. 19. Besides, in the case where the amount of spring-go that occurs in the preliminary bend portion 50*p* and other amounts of spring-go are taken into account in the construction of the forming die device so that the workpiece 50 is overbent, an offset dimension that makes it possible to obtain a desired amount of change in angle according to the magnitude of the angle of the overbend is selected to form the final formed article 5. In this manner, the final formed article 5 having exactly the target angles can be formed highly accurately.

The invention claimed is:

1. A workpiece bending method of forming a final formed article that has two surfaces on opposite sides of an inclined area by bending a flat workpiece using a stationary die and a movable die, wherein a shape of the inclined area in the final formed article is made up of a first bend portion, a second bend portion, and a flat surface portion sandwiched between the first bend portion and the second bend portion, comprising:

cantilevering a workpiece by clamping an end portion of the workpiece by the stationary die and a holding member that is disposed facing the stationary die; and curving an area in the workpiece that corresponds to the flat surface portion of the inclined area to a same direction as the first bend portion and the second bend portion by moving the movable die to the stationary die so that the movable die presses a free-side end of the cantilevered workpiece toward the stationary die, and of then forming the first bend portion and the second bend portion by causing the movable die to press the workpiece to the stationary die whose shapes correspond to a shape of the inclined area in the final formed article, and unbending the area in the workpiece that corresponds to the flat surface portion of the inclined area, wherein, before the workpiece is pressed by the movable die to the stationary die, a stabilized bend portion is formed in the workpiece by bringing the workpiece into contact with an area in the stationary die that is provided for forming the second bend portion, and after the stabilized bend portion is formed, the stabilized bend portion is unbent by causing the movable die to press the workpiece to the stationary die.

2. A workpiece bending method of forming a final formed article that has two surfaces on opposite sides of an inclined area by bending a flat workpiece using a stationary die and a movable die, wherein a shape of the inclined area in the final formed article is made up of a first bend portion, a second bend portion, and a flat surface portion sandwiched between the first bend portion and the second bend portion, comprising:

forming a preliminary bend portion having the same bend direction as the first bend portion and the second bend portion, in an area in a workpiece that corresponds to the flat surface portion of the inclined area;

cantilevering the workpiece by clamping an end portion of the workpiece by the stationary die and a holding member that is disposed facing the stationary die; and curving an area in the workpiece that corresponds to the flat surface portion of the inclined area by moving the movable die to the stationary die so that the movable die presses a free-side end of the cantilevered workpiece toward the stationary die, and of then forming the first bend portion and the second bend portion by causing the movable die to press the workpiece to the stationary die whose shapes correspond to a shape of the inclined area in the final formed article, and unbending the area in the workpiece that corresponds to the flat surface portion of the inclined area and that includes the preliminary bend portion, wherein, before the workpiece is pressed by the movable die to the stationary die, a stabilized bend portion is formed in the workpiece by bringing the workpiece into contact with an area in the stationary die that is provided for forming the second bend portion, and after the stabilized bend portion is formed, the stabilized bend portion is unbent by causing the movable die to press the workpiece to the stationary die.

* * * * *